US007425156B2

(12) United States Patent
Maebashi et al.

(10) Patent No.: US 7,425,156 B2
(45) Date of Patent: Sep. 16, 2008

(54) CONNECTOR STRUCTURE

(75) Inventors: Akemi Maebashi, Ogasa-gun (JP); Hiroaki Yamada, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/196,265

(22) Filed: Aug. 4, 2005

(65) Prior Publication Data

US 2006/0030217 A1 Feb. 9, 2006

(30) Foreign Application Priority Data

Aug. 6, 2004 (JP) ..... P2004-230587

(51) Int. Cl.
*H01R 13/66* (2006.01)

(52) U.S. Cl. ..... 439/620.21

(58) Field of Classification Search ..... 439/620, 439/723, 724

See application file for complete search history.

(56) References Cited

U.S. PATENT DOCUMENTS

| | | | | |
|---|---|---|---|---|
| 4,330,164 | A * | 5/1982 | Pittman et al. | 439/293 |
| D426,811 | S * | 6/2000 | White et al. | D13/147 |
| 6,690,582 | B2 * | 2/2004 | Sumida | 361/752 |
| 6,790,067 | B2 * | 9/2004 | Douty et al. | 439/284 |
| 6,964,585 | B2 * | 11/2005 | Blichasz et al. | 439/638 |
| 6,997,736 | B2 * | 2/2006 | Costello et al. | 439/378 |
| 2005/0159024 | A1 * | 7/2005 | Yamada et al. | 439/64 |

FOREIGN PATENT DOCUMENTS

| | | |
|---|---|---|
| JP | 64-54677 A | 3/1989 |
| JP | 9-219259 A | 8/1997 |

* cited by examiner

*Primary Examiner*—Neil Abrams
*Assistant Examiner*—Phuong Nguyen
(74) *Attorney, Agent, or Firm*—Sughrue Mion, PLLC

(57) ABSTRACT

Circuit members and electrical parts, connected to the circuit members, are mounted within a pair of division housings and terminals, extending from the circuit members, project outwardly from the division housings, and the two division housings are joined together to form a connector. Walls of the pair of division housings are alternately superposed together. An opening is formed in an outer wall of each of the two division housings, and the circuit members are exposed through the opening. The electrical parts, mounted within the two division housings, are arranged alternately. The pair of division housings, jointed together, are received within a case, and the case has a hood portion for the connector.

14 Claims, 6 Drawing Sheets

CONNECTOR STRUCTURE

BACKGROUND OF THE INVENTION

This invention relates to a connector structure in which electrical parts such as relays are mounted in division-type connector housings, and the two division connector housings are combined together to form a connector.

FIG. 9 shows one related connector structure (see JP-A-9-219259).

This connector structure comprises a connector housing 91 made of a synthetic resin, a relay 92 received within the connector housing 91, male terminals 93 and 94 of the relay 92, and other male terminals 98 connected to a circuit board (not shown) disposed at a lower side.

The relay 92 comprises a coil 95, and an iron core 96, and a movable plate 97 is located in proximity to the iron core 96. The movable plate 97 is continuous with one male terminal 93, and a basal portion of the other male terminal 93 is disposed in proximity to a contact 97*a* of the movable plate 97, and a distal end of the coil 95 is connected to the lower male terminal 94. The male terminals 93 and 94 and the other male terminals 98 have vertical portions 93*a*, 94*a* and 98*a*, respectively, and these vertical portions are connected by soldering to the lower-side circuit board (not shown).

A rear wall 91*a* of the connector housing 91 can be opened and closed through a hinge. The rear wall 91*a* is opened, and in this condition the relay 92 and the terminals 93, 94 and 98 are mounted within the connector housing 91. A connector, having mating female terminals, is fitted into a connector fitting chamber 91*b* of the connector housing 91.

In the above related connector structure, however, the terminals and the relay must be mounted in the narrow space within the connector housing while the narrow rear wall of the connector housing was kept in the open condition, and this has invited a problem that the efficiency of the operation for mounting these parts is low. Another problem is that a large unoccupied space was formed in the internal space of the connector housing (in which the relay was received), so that the connector had an increased size.

SUMMARY OF THE INVENTION

With the foregoing in view, it is an object of this invention to provide a connector structure in which parts can be efficiently mounted within a connector housing, and besides the connector can be formed into a compact size.

In order to accomplish the above object, a connector structure of the present invention is characterized by having the following arrangement.

(1) A connector structure comprising:

a first division housing;

a first circuit member that is mounted on a first surface of the first division housing;

a first electrical part is mounted on the first circuit member;

a second division housing;

a second circuit member that is mounted on a second surface of the second division housing;

a second electrical part is mounted on the second circuit member, wherein the first surface faces to the second surface, and the first division housing is joined to the second division housing.

(2) A connector structure according to (1) further comprising terminals that are connected to the first and second circuit members, respectively, and project outwardly from the first and second division housings, respectively.

(3) A connector structure according to (1), wherein the first and second division housings are formed with opposite side walls at a periphery end portion thereof, respectively, and the opposite side walls of the first division housing and the opposite side walls of the second division housing that accord to each other are superposed.

(4) A connector structure according to (1), wherein the first and second division housings include means for provisionally fixing the first and second division housings to each other.

(5) A connector structure according to (1), wherein the first division housing is formed with an opening through which the first circuit member is exposed at a first outer surface that is opposed to the first surface, and the second division housing is formed with an opening through which the second circuit member is exposed at a second outer surface that is opposed to the second surface.

(6) A connector-structure according to (1), wherein the first and second electrical parts are arranged alternatively in a direction perpendicular to a mounting direction in which the first electrical part is mounted on the first circuit member.

(7) A connector structure according to (6), wherein the first division housing comprises a plurality of the first electric parts, and the second division housing comprises a plurality of the second electric parts.

(8) A connector structure according to (1) further comprising a case that receives the first and second division housings which are joined each other.

(9) A connector structure according to (8), wherein the first division housing is formed with an opening through which the first circuit member is exposed at a first outer surface that is opposed to the first surface, the second division housing is formed with an opening through which the second circuit member is exposed at a second outer surface that is opposed to the second surface, and the case covers the openings of the first and second division housings.

(10) A connector structure according to (1), the first and second circuit members are same shape.

(11) A method of producing a connector comprising:

providing a pair of division housings;

mounting circuit members on the pair of division housings, respectively;

mounting electrical parts on the circuit members of the pair of division housings, respectively; and joining the pair of division housings so that surfaces of the pair of division housings on which the circuit members and the electrical parts are mounted face to each other.

(12) A method of producing a connector according to (11) further comprising inserting the pair of division housings which are joined each other into a case.

According to the invention, the circuit member is mounted on each of the two division housings, and terminals of the electrical part are connected to the circuit member by welding or the like, and the two division housings are joined together (combined together). By doing so, there is formed the connector containing the electrical parts therein. The terminals of the circuit members are arranged in at least two rows. A mating connector is jointed to the connector, and terminals of the mating connector are connected respectively to the terminals of the circuit members. Bus bars are suitably used as the circuit members, and wires can be used as the circuit members. Examples of the electrical part include a relay and a box-like fuse.

According to the invention, the two division housings, while accurately positioned relative to each other, can be smoothly joined together. The two division housings may be locked to each other by retaining means such as retaining projections and retaining recesses. Alternatively, the two division housings may not be locked to each other, in which case the walls of the two division housings are alternately superposed together, thereby provisionally fixing the two division housings to each other, and in this condition the two division housings are inserted into a case.

According to the invention, in an open condition of the division housings, terminals of the electrical part can be easily connected by welding or the like to the circuit member through the opening formed in the outer wall of each division housing. The opening is used as an operation window. Examples of the electrical part include a relay, a fuse and a resistor.

According to the invention, for example, the electrical part is provided at an upper portion of one of the two division housings, while the electrical part is provided at a lower portion of the other division housing, or the electrical part is provided at a right portion of the one division housing, while the electrical part is provided at a left portion of the other division housing. When the two division housings are combined together, the electrical parts of the two division housings are arranged alternately, so that a space within the two division housings can be efficiently utilized.

According to the invention, for example, the walls of the two division housings are superposed together, thereby provisionally fixing the two division housings to each other, and then the two division housings are inserted into the case, and is received therein without shaking. As a result, the case covers the connector to completely fix the two division housings to each other, and the terminals of the connector are received within a hood portion, and therefore are protected from interference with the exterior. The mating connector is fitted into the hood portion, so that the terminals of the mating connector are connected respectively to the terminals of the connector.

According to the invention, the circuit members of the same shape can be used in the two division housings, and therefore the two circuit members are disposed line-symmetrically when the two division housings are combined together.

According to the invention, in the open condition of the division housings (before the division housings are combined together), the circuit member and the electrical part can be efficiently mounted in each division housing, and after the mounting of these parts, the two division housings are combined together. By doing so, the connector, having the complicated internal structure, can be efficiently produced.

According to the invention, the two division housings, while accurately positioned relative to each other, can be smoothly joined together, and therefore the efficiency of the connector assembling operation is enhanced.

According to the invention, in the open condition of the division housings, the terminals of the electrical part can be easily connected by welding or the like to the circuit member through the opening formed in the outer wall of each division housing, and therefore the efficiency of the operation for mounting the parts in the connector, as well as the efficiency of the parts-connecting operation, can be enhanced.

According to the invention, the electrical parts can be mounted at a high density within the connector in a space-saving manner, efficiently utilizing the space within the two division housings, so that a compact design of the connector can be achieved.

According to the invention, for example, the two division connectors are not locked to each other, but are merely held in the closed condition, and in this condition the two division housings are received in the case, and by doing so, the two division housings can be fixed to each other, so that the efficiency of the connector assembling operation is enhanced.

According to the invention, the circuit members of the same shape are used, and by doing so, the cost is reduced, and besides the assembled connector structure has the simplified and spacing-saving design thanks to the line-symmetrical circuit construction.

DETAIL DESCRIPTION OF PREFERRED EMBODIMENTS

Figure 1:
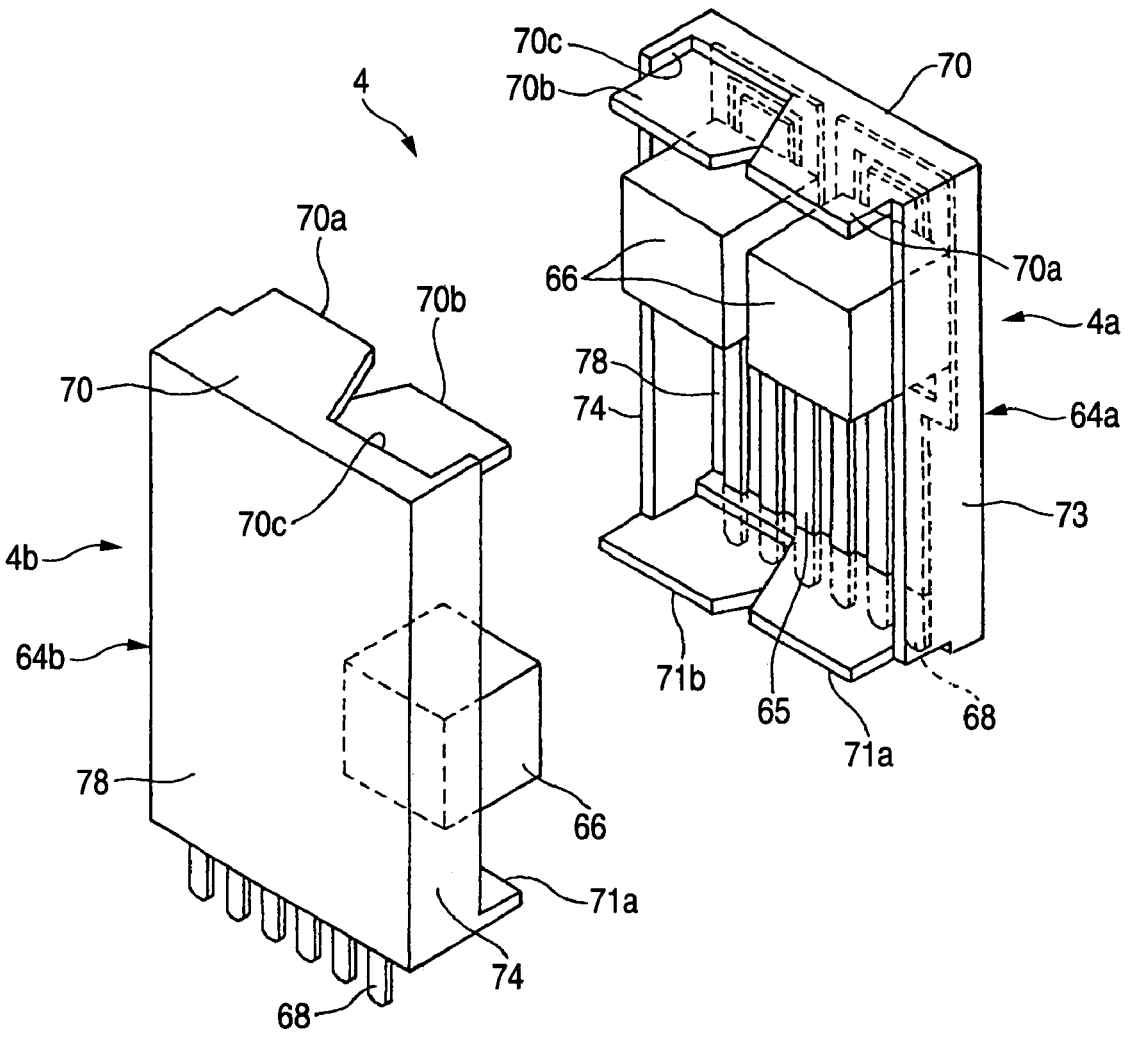
FIG. 1 is an exploded, perspective view showing one preferred embodiment of a connector structure of the present invention.

FIG. 1 shows one preferred embodiment of a connector structure of the present invention.

This connector structure comprises (half-division) division housings 64*a* and 64*b* made of an insulative resin, bus bars (circuit members) 65 which are made of electrically-conductive metal, and are installed in the division housings 64*a* and 64*b*, relays (electrical parts) 66 which are provided within the division housings 64*a* and 64*b*, and are connected to the bus bars 65, and male terminals 68 of the bus bars 65 projecting outwardly from the division housings 64*a* and 64*b*. The two division housings 64*a* and 64*b* are joined together (combined together) to form one connector 4.

The two division housings 64*a* and 64*b* have the same shape, and each of the two division housings includes upper and lower stepped walls 70 and 71, left and right walls 73 and 74, and a front wall 78 or a rear wall 78. The upper wall 70 includes a right half wall portion 70*a* disposed at an upper side, and a left half wall portion 70*b* disposed at a lower side. A step-like recess 70*c* is formed at an upper side of the left half wall portion 70*b*. The lower wall 70 includes a right half wall portion 71*a* disposed at an upper side, and a left half wall portion 71*b* disposed at a lower side. A step-like recess is formed at a lower side of the right half wall portion 71*a*.

When the two division housings 64*a* and 64*b* are joined together, the upper walls 70 of the two division housings 64*a* and 64*b* are superposed together in a vertical direction, while the lower walls 71 are also superposed together in the vertical direction, so that the two division housings 64*a* and 64*b* are provisionally fixed to each other. The length of projecting of the left and right walls 73 and 74 from the front (or the rear) wall 78 is substantially equal to a half of the thickness of the connector 4, and the length of projecting of the upper and lower walls 70 and 71 is larger than the length of projecting of the left and right walls 73 and 74. There can be adopted a construction in which when the two division housings 64*a* and 64*b* are joined together, the left and right walls 73 and 74 of the division housing 64*a* are not joined respectively to the right and left walls 74 and 73 of the division housing 64*b*, with a gap formed between the mating walls 73 and 74 (When the upper and lower walls 70 and 71 are closely fitted together with no gap formed therebetween, a sufficient provisionally-fixing force can be obtained.).

The bus bars 65 are installed in a predetermined form on the front (or the rear) wall 78 of the division housing 64*a*, 64*b*, and at least the male terminals 68 are arranged at equal intervals in parallel relation to one another. The male terminals 68 extend through a basal portions of the lower walls 71 of the division housings 64*a*, 64*b*, and project outwardly therefrom. Terminals of each relay 66 are connected to the corresponding bus bars 65 by welding or the like. Other parts (such for example as resistors) than the relays 66 can be connected to the bus bars 65.

In this embodiment, two relays 66 are mounted on an upper half portion of one division housing 64*a*, while two relays 66 are mounted on a lower half portion of the other division housing 64*b*. When the two division housings 64*a* and 64*b* are combined together, the pair of relays 66 on the division housing 64*a* and the pair of relays 66 on the division housing 64*b* are disposed in parallel, closely spaced relation to each other in the upward-downward direction.

There can be adopted a construction in which the two relays 66 on the one division housing 64*a* are arranged on a slanting line, that is, arranged in a staggered manner, while the two relays 66 on the other division housing 64*b* are also arranged in a staggered manner as is the case with the one division housing 64*a*. In this case, when the two division housings 64*a* and 64*b* are combined together, the two pairs of the relays 66 are disposed in parallel, closely spaced relation to each other in the upward-downward direction. The pattern of arrangement of the relays 66 and the number of the relays 66 can be suitably determined.

A division connector 4*a* comprises the division housing 64*a*, the bus bars 65, and the relays 66, while a division connector 4*b* comprises the division housing 64*b*, the bus bars 65, and the relays 66. The two division connectors 4*a* and 4*b* are combined together to form the single connector 4. In the case where a case 5 (FIG. 2) described later is used, it is only necessary to provisionally fix the two division housings 64*a* and 64*b* together through the upper and lower walls 70 and 71. In the case where the case 5 is not used, the mating left and right walls 73 and 74 are locked to each other by retaining means comprising, for example, retaining projections and engagement recesses.

In the case where the case is not used, the division housings 64*a* and 64*b* can be extended downwardly to form a hood portion (not shown) covering the male terminals 68. A connector fitting chamber is formed within the hood portion, and a mating connector, receiving female terminals therein, can be fitted into this connector fitting chamber. Alternatively, a connector fitting chamber of a mating connector (not shown) can be fitted on the division housings 64*a* and 64*b*.

There can be adopted a construction in which the upper walls 70, as well as the lower walls 71, are not superposed together, and instead the mating left and right walls 73 and 74 are superposed together in the direction of the thickness of these walls, thereby provisionally fixing the two division housings 64*a* and 64*b* together. In this case, the upper walls 70, as well as the lower walls 71, can be locked to each other by retaining means (not shown). In the case where the case 5 (FIG. 2) is used, an opening can be formed in the front (or the rear) wall 78 of each of the division housings 64*a* and 64*b* as in an embodiment (described later), so that the wall 78 is formed into a frame-shaped wall. In this case, the terminals of the relays 66, resistors, etc., can be welded to the bus bars 66 through the opening.

The internal structures (that is, the arrangement, shape, etc., of the bus bars 65, the kind, rating, etc., of the electrical parts (such as the relays 66 and the resistors) of the two division connectors 4*a* and 4*b* may be identical to or different from each other. Instead of the relays 66, fuses (box-shaped fusible links) can be mounted within the division housings. Instead of using the male terminals 68, the distal end portions of the bus bars 65 can be bent to form female terminals (not shown).

Figure 2:
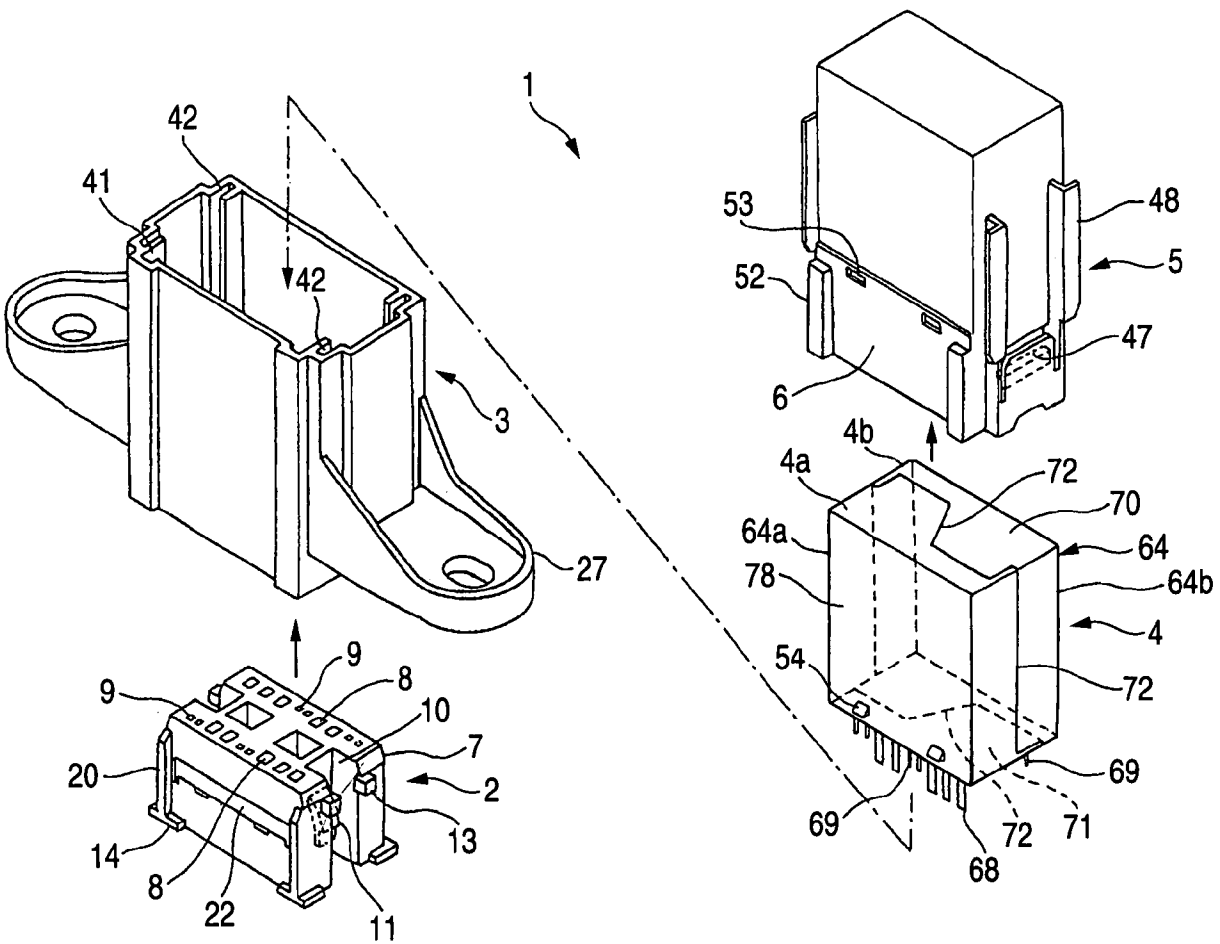
FIG. 2 is an exploded, perspective view showing a connection module provided with one form of a connector structure of the invention.

FIG. 2 shows one form of a connection module provided with a connector structure of the invention. Although this connector structure is different in arrangement, shape of male terminals 68 from the connector structure of FIG. 1, explanation thereof will be made, using the same reference numerals as used for FIG. 1 for convenience' sake.

The connection module 1 comprises a waiting-side (mating) connector 2, a frame 3 for receiving the connector 2 therein in a retained condition, a division-type connector 4 for connecting to the connector 2, and the case 5 having a hood portion 6 for the connector 4. The case 5 receives the connector 4 therein, and in this condition the case 5 is inserted into the frame 3.

Figure 3:
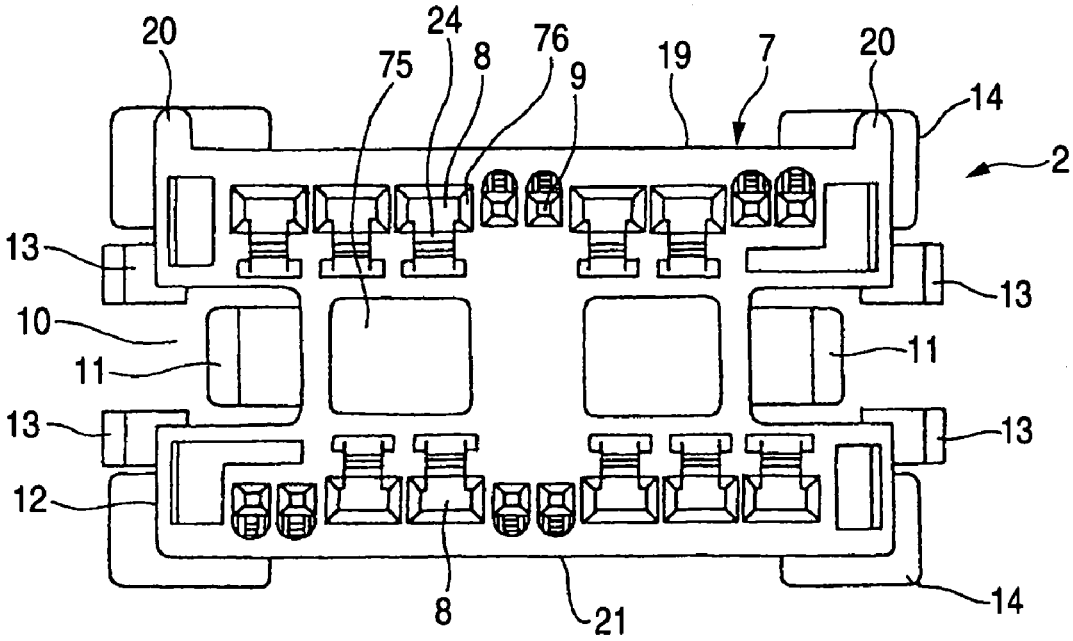
FIG. 3 is a plan view showing a mating connector of the connection module.
Figure 4:
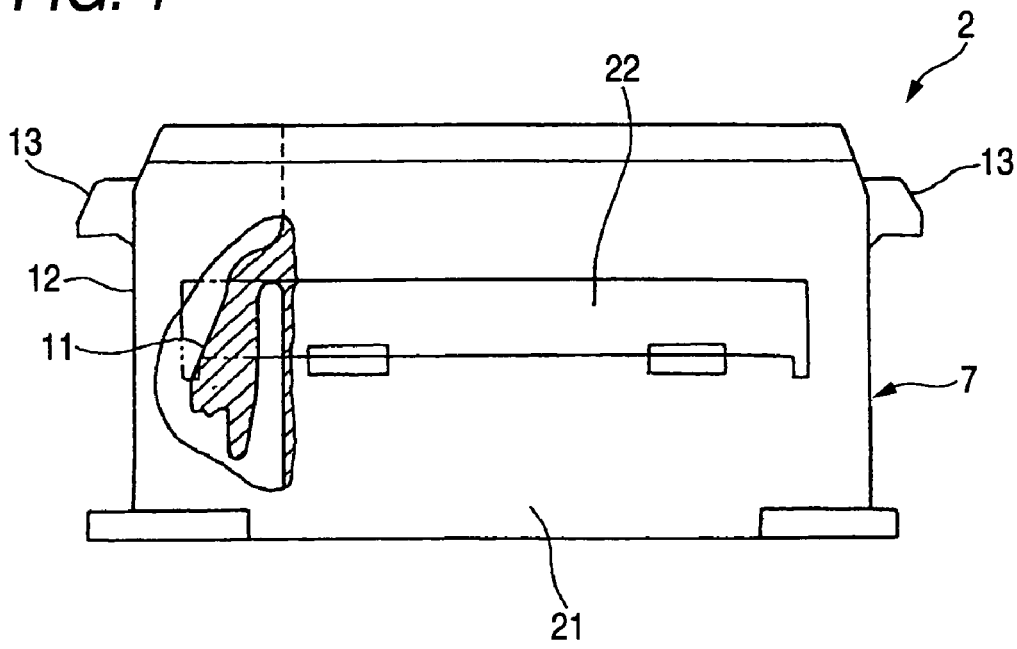
FIG. 4 is a front-elevational view of the mating connector.

As shown in FIGS. 3 to 4, the waiting-side connector 2 comprises a connector housing 7 made of a synthetic resin, and a plurality of wire-connected female terminals (not shown) received within the connector housing 7. The connector housing 7 has two (front and rear) parallel rows of terminal receiving chambers 8 and 9 spaced from each other in a direction of the thickness of this connector housing 7. The terminal receiving chambers 8 in each row are larger in size than the terminal receiving chambers 9. The connector housing 7 has spaces 75 formed between the two (front and rear) rows of terminal receiving chambers 8 and 9 such that the spaces 75 are disposed centrally of the thickness of the connector housing 7. Two recesses 10 are formed respectively in left and right sides of the connector housing 7, and are disposed centrally of the thickness of the connector housing 7.

The front row of terminal receiving chambers 8 and 9 and the rear row of terminal receiving chambers 8 and 9 are arranged point-symmetrically. The consecutive larger terminal receiving chambers 8 are arranged at equal intervals, and the consecutive smaller terminal receiving chambers 9 are arranged at equal intervals. The terminal receiving chambers 8 and 9 have stopper walls 76 formed respectively at their upper ends. Openings are formed through the stopper walls 76, and male terminals 68 and 69 of the division-type connector 4 (FIG. 2) are inserted into these openings, respectively. An elastic terminal-retaining lance (not shown) is formed within each of the terminal receiving chambers 8 and 9. The male terminals, received respectively in each row of terminal receiving chambers 8 and 9, are retained in a double manner by a side spacer 22. The centerlines of the large and small terminal receiving chambers 8 and 9 (the axes of insertion for the male terminals 68 and 69 of the connector 4) of each row are disposed in a common plane.

In this specification, although wide wall surfaces 19 and 21 of the connector housing 7 are defined as the front and rear sides, while narrow wall surfaces 12 are defined as left and right sides, the definitions of the front, rear, left, right, upper and lower sides are given merely for description purposes, and will not always accord with the direction of mounting of the connection module 1.

Elastic retaining arms 11 for the frame 3 (FIG. 2) are provided respectively in the recesses 10 formed respectively in the left and right sides of the connector housing 7, and extend downwardly. A pair of front and rear lock projections 13 for the case 5 (FIG. 2) are formed on an upper portion of each of the opposite (left and right) side walls 12, and are disposed respectively on opposite sides of the recess 10. Stopper flanges 14 for the frame 3 are formed respectively at four corners of the connector housing 7 at the lower end thereof.

Figure 5:
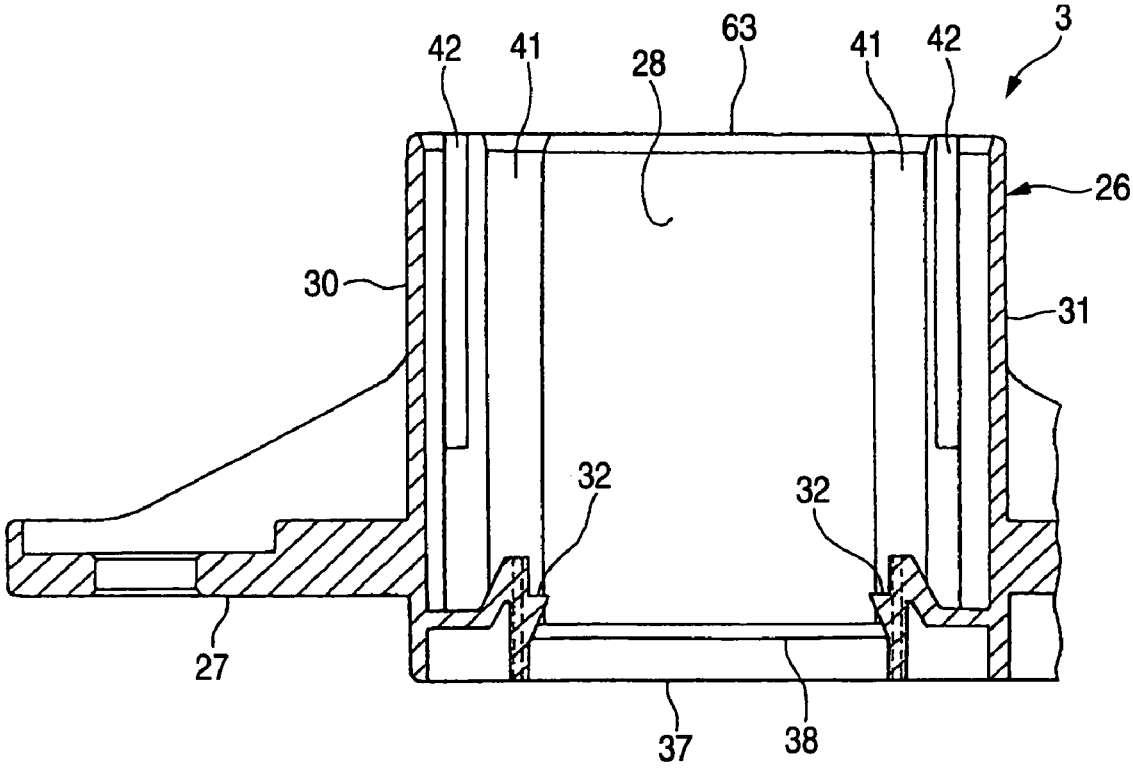
FIG. 5 is a vertical cross-sectional view of a frame for retaining the mating connector.

As shown in FIG. 5, the frame 3 is formed into an integral construction, using a synthetic resin, and this frame 3 includes a frame body 26 of a rectangular tubular shape, and brackets 27 for fixing the frame body 26 to a fixing side such as a vehicle body. The frame body 26 has vertical front, rear, left and right walls, and a pair of inwardly-directed engagement projections 32 for the retaining arms 11 of the connector 2 (FIG. 2) are formed respectively on inner surfaces of lower end portions of the left and right walls 30 and 31.

The connector 2 (FIG. 2) is inserted into the frame 3 through an opening 37 formed in the lower end of this frame 3, and the retaining arms 11 (FIG. 4) of the connector 2 are retainingly engaged with the engagement projections 32, respectively, and at the same time the flanges 14 of the connector 2 abut against an inner flange 38 formed on the lower end portion of the frame 3. The connector 2, thus received within the frame 3, serves as a waiting connector.

A pair of notch grooves (not shown) for positioning ribs 20 (FIG. 2) on the front wall of the connector 2 are formed in a front wall 28 of the frame 3 (FIG. 5), and are disposed outwardly of left and right ends of the flange 38, respectively. A pair of vertically-extending guide recesses 41 are formed in the inner surface of the front wall 28, and communicate respectively with the notch grooves. A pair of vertically-extending guide grooves 42 are formed respectively at generally upper half portions of the left and right end portions of the front wall 28, and are disposed adjacent respectively to the outer sides of the guide recesses 41, and another pair of vertically-extending guide grooves 42 are formed respectively at generally upper half portions of left and right end portions of a rear wall of the frame 3.

Figure 6:
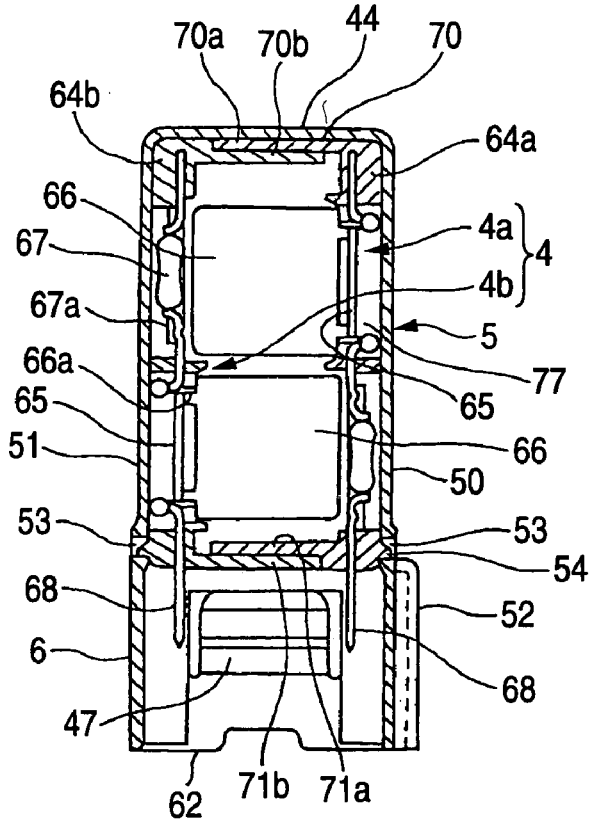
FIG. 6 is a cross-sectional view showing a condition in which one form of division-type connector of the connection module is fitted in a case.
Figure 7:
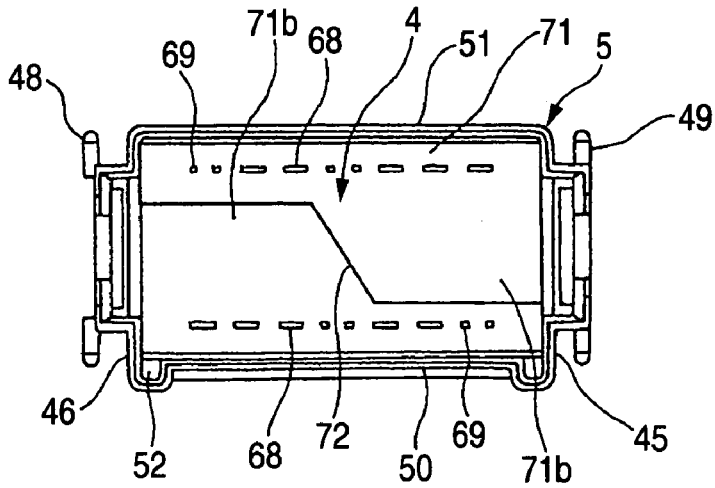
FIG. 7 is a bottom view showing the connector received within the case.
Figure 8:
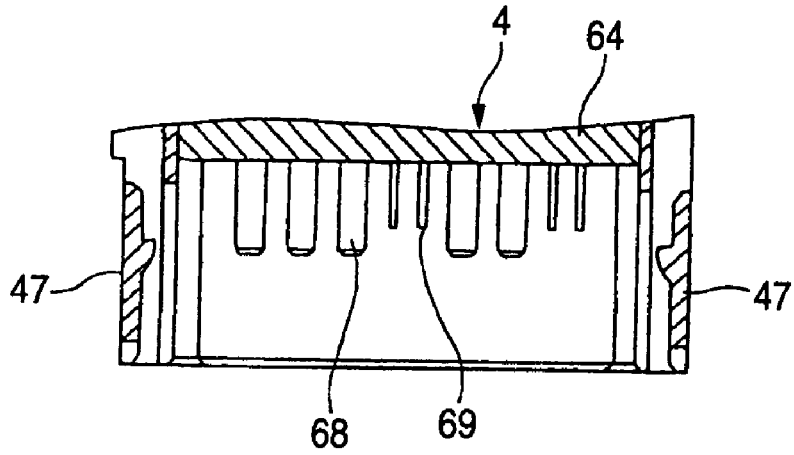
FIG. 8 is a vertical cross-sectional view showing male terminals of the connector received within the case.
Figure 9:
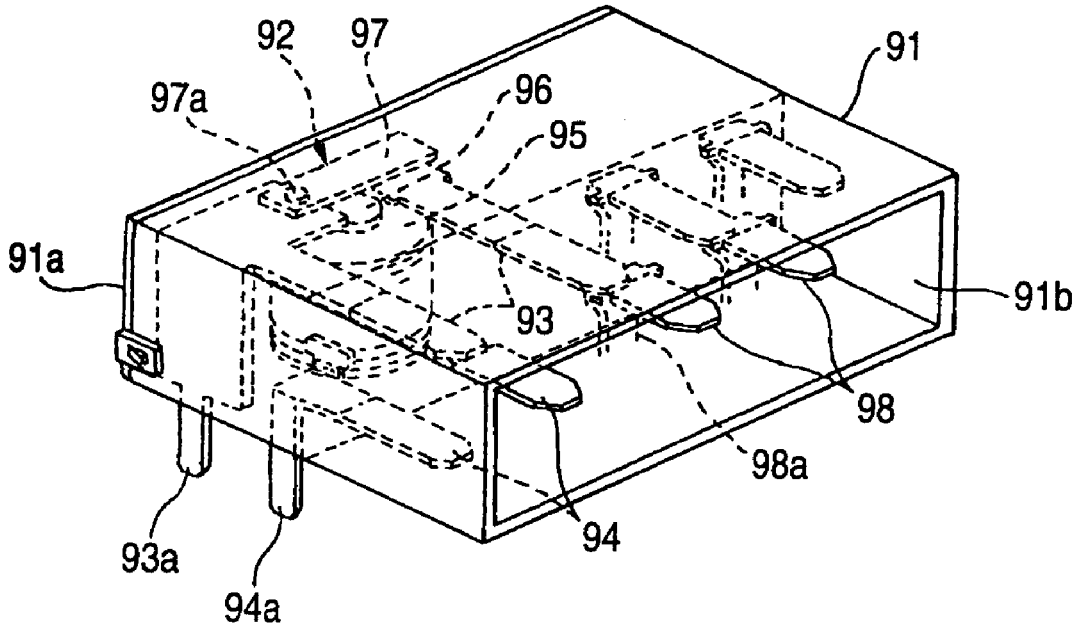
FIG. 9 PRIOR ART
FIG. 9 is a perspective view showing one related connector structure.

As shown in FIGS. 6 to 8, the case 5 is formed into a rectangular tubular shape, using a synthetic resin, and has an upper wall 44. Elastic lock piece portions 47 for the connector 4 are formed respectively on lower portions of right and left walls 45 and 46. A pair of guide rails 48 for the frame 3 (FIG. 2) are formed on a generally lower half portion of the left wall 46, and are disposed above the lock piece portion 47, while a pair of guide rails 49 for the frame 3 are formed on a generally lower half portion of the right wall 45, and are disposed above the lock piece portion 47. A pair of left and right guide grooves 52 for sliding engagement with the ribs 20 of the connector 2 (FIG. 2) and the guide recesses 41 of the frame 3 are formed respectively in an inner surface of a generally lower half portion of a front wall 50 of the case 5. A pair of retaining holes 53 for engagement projections 54 of the connector 4 are formed in the front wall 50, while another pair of retaining holes 53 for engagement projections 54 of the connector 4 are formed in a rear wall 51 of the case 5, these retaining holes 53 being disposed at a level above the guide recesses 52.

The connector 4 is fitted into the case 5 through a lower end opening 62 (FIG. 6) thereof, and in this condition the case 5 is inserted downwardly into the frame 3 (FIG. 5) through an upper end opening 63 thereof, so that the connector 4 is joined to the connector 2 retained at the lower portion of the frame 3, and is electrically connected thereto.

The connector 4 can be divided into two (front an rear) sections (division housings 64*a* and 64*b*) along a division surface 72, and upper walls 70 of the division housings 64*a* and 64*b* (of a connector housing 64), as well as lower walls 71 thereof, are fitted together in such a manner that their convex portions are fitted in corresponding concave portions thereof, so that the two division housings 64*a* and 64*b* are provisionally fixed to each other.

As shown in FIGS. 6 to 8, the division-type connector 4 comprises the connector housing 64 (comprising the division housings 64*a* and 64*b*) of a hollow rectangular frame shape made of a synthetic resin, a plurality of bus bars (made of electrically-conductive metal) received or installed within the connector housing 64, relays 66 which are provided within the connector housing 64, and are connected to the bus bars 65, resistors 67 connected to the bus bars 65, and the male terminals 68 and 69 of the bus bars 65 projecting outwardly from the connector housing 64.

The connector housing 64 of the connector 4 can be divided into the two sections at a region disposed centrally of the thickness thereof. An opening 77 is formed in each of front and rear walls (outer walls) of the connector housing 64, so that each of the front and rear walls is in the form of a frame-shaped wall. Terminals 66*a* of the relays 66 and terminals 67*a* of the resistors 67 can be welded to the bus bars 65 through the openings 77 of the frame-shaped walls. With this construction, it is necessary to provide the case 5 for covering the openings 77 formed respectively in the front and rear walls of the connector housing 64.

In the connector housing 64 shown in FIG. 2, the openings 77 in the front and rear walls 78 is omitted, and this connector housing 64 includes the upper, front, rear, right and left walls. For description purposes, identical reference numerals are used for the connectors 4 of FIGS. 1, 2 and 6 to 8.

The bus bars 65, the relays 66 and the resistors 67 are mounted in each of division connectors 4*a* and 4*b*, and the positions of the relays 66 in the division connector 4*a* are different from the positions of the relays 66 in the division connector 4*b*, and when the two division connectors 4*a* and 4*b* are combined together, the relays 66 are arranged alternately or in a staggered manner.

The male terminals 68 and 69 are arranged in two (front and rear) rows in the connector housing 64, and each row includes the wide long tab terminals 68, and the narrow short pin terminals 69, and the two rows of male terminals 68 and 69 are arranged point-symmetrically.

The tab terminals 68 are inserted respectively into the female terminals (not shown) received respectively in the larger terminal receiving chambers 8 in the connector 2, and are electrically connected thereto, while the pin terminals 69 are inserted respectively into the female terminals (not shown) received respectively in the smaller terminal receiving chambers 9 in the connector 2.

The tab terminals 68 are continuous with (that is, connected integrally to) the respective wide bus bars 65 within the connector housing 64, while the pin terminals 69 are continuous with (that is, connected integrally to) the respective narrow bus bars 65 within the connector housing 64. The bus bars 65 are fixed to the frame-shaped connector housing 64 by molding or the like.

The tab terminals 68 project longer than the pin terminals 69, and are inserted respectively into the larger female terminals (not shown) earlier than the pin terminals 69, and then the pin terminals 69 are inserted respectively into the smaller female terminals (not shown). Therefore, the thin pin terminals 69 are prevented from being bent or deformed by gouging or the like, and the male terminals are positively and smoothly connected to the respective female terminals.

In the case where the relays 66 and the resistors 67 are connected (welded) to the bus bars 65 from the inner side of each of the two division connectors where the central division surface is disposed, the connector housing 64 can be formed into such a construction that this connector housing 64 has the front and rear walls 78 as shown in FIGS. 1 and 2, and also the front, left and right walls 78, 73 and 74 are extended in the direction of projecting of the male terminals to form the hood portion 6. In this case, when guide rails 48 and 49 are formed on the left and right walls 73 and 74, and the lock piece portions 47 and guide recesses 52 are provided at the hood portion 6, then the use of the case 5 can be omitted.

In the connector housing 64 of FIG. 6, the pair of left and right engagement projections 54 are formed on the lower portion (disposed near to the male terminals 68 and 69) of each of the front and rear frame-shaped walls. When the connector 4 is inserted (or fitted) into the case 5 through the lower end opening 62 thereof, the engagement projections 54 are engaged respectively in the retaining holes 53 in the case 5, so that the upper wall 70 of the connector 4 is held in contact with the inner surface of the upper wall 44 of the case 5. One engagement projection 54 can be formed on the central portion of each of the front and rear walls of the connector housing 64, while one retaining hole 53 can be formed in the central portion of each of the front and rear walls of the case 5. These detailed construction can be suitably changed.

In this embodiment, when the case 5, holding the connector 4, is inserted into the frame 3, the front end surface of the connector 4 is held in contact with the front end surface of the mating connector 2, and the male terminals 68 and 69 of the connector 4 are inserted respectively into the female terminals received respectively in the terminal receiving chambers 8 and 9 of the connector 2, and are connected respectively to these female terminals.

Instead of being used as the waiting connector to be mounted in the frame 3, the connector 2 can be used as a wire harness connector so as to be connected to the division-type connector 4. Instead of the bus bars 65, wires can be used as the circuit members.

What is claimed is:

1. A connector structure comprising:

a first division housing;

a first circuit member that is mounted on a first surface of the first division housing;

a first electrical part is mounted on the first circuit member, the first circuit member being disposed between the first surface of the first division housing and the first electrical part;

a second division housing;

a second circuit member that is mounted on a second surface of the second division housing;

a second electrical part is mounted on the second circuit member, the second circuit member being disposed between the second surface of the second division housing and the second electrical part, wherein the first surface faces the second surface, and the first division housing is joined to the second division housing;

wherein the first and second electrical parts are arranged alternatively in a first direction perpendicular to a second direction in which the first electrical part is mounted on the first circuit member such that when said first and second division housings are joined together, said first and second electrical parts are disposed one above the other in the first direction such that a line extending in the first direction and passing through the first electrical part also passes through the second electrical part.

2. A connector structure according to claim 1 further comprising terminals that are connected to the first and second circuit members, respectively, and project outwardly from the first and second division housings, respectively.

3. A connector structure according to claim 1, wherein the first and second division housings are formed with opposite side walls at a periphery end portion thereof, respectively, and the opposite side walls of the first division housing and the opposite side walls of the second division housing that accord to each other are superposed.

4. A connector structure according to claim 1, wherein the first and second division housings include means for provisionally fixing the first and second division housings to each other.

5. A connector structure according to claim 1, wherein the first division housing is formed with an opening through which the first circuit member is exposed at a first outer surface that is opposed to the first surface, and the second division housing is formed with an opening through which the second circuit member is exposed at a second outer surface that is opposed to the second surface.

6. A connector structure according to claim 1, wherein the first division housing comprises a plurality of the first electric parts, and the second division housing comprises a plurality of the second electric parts.

7. A connector structure according to claim 1, the first and second circuit members are same shape.

8. A connector structure according to claim 1, wherein at least a part of the first electrical part is overlapped with the second electrical part in the first direction.

9. A connector structure according to claim 1 further comprising a case that receives the first and second division housings which are joined each other.

10. A connector structure according to claim 9, wherein the first division housing is formed with an opening through which the first circuit member is exposed at a first outer surface that is opposed to the first surface, the second division housing is formed with an opening through which the second circuit member is exposed at a second outer surface that is opposed to the second surface, and the case covers the openings of the first and second division housings.

11. A method of producing a connector comprising:

providing a pair of division housings;

mounting circuit members on the pair of division housings, respectively;

mounting electrical parts on the circuit members of the pair of division housings, respectively; and joining the pair of division housings so that surfaces of the pair of division housings on which the circuit members and the electrical parts are mounted face to each other, the steps being performed in the stated order.

12. A method of producing a connector according to claim 11 further comprising inserting the pair of division housings which are joined each other into a case.

13. A method of producing a connector according to claim 11, wherein the electrical parts are arranged alternatively in a first direction perpendicular to a second direction in which one of the electrical parts is mounted on the mating circuit member such that when said first and second division housings are joined together, said first and second electrical parts are disposed one above the other in the first direction such that a line extending in the first direction and passing through the first electrical part also passes through the second electrical part.

14. A method of producing a connector according to claim 13, wherein at least a part of one of the electrical parts is overlapped with the other of the electrical parts in the first direction.

* * * * *